US005257007A

United States Patent [19]

Steil et al.

[11] Patent Number: 5,257,007

[45] Date of Patent: Oct. 26, 1993

[54] PORTABLE SECURITY SYSTEM

[75] Inventors: David J. Steil, Yardley; Gregory J. Borsos, Langhorne, both of Pa.

[73] Assignee: M-Tec Corporation, Pennsauken, N.J.

[21] Appl. No.: 769,605

[22] Filed: Oct. 1, 1991 (Under 37 CFR 1.47)

[51] Int. Cl.[5] ..... G08B 1/08

[52] U.S. Cl. ..... 340/539; 340/531; 340/693

[58] Field of Search ..... 340/539, 531, 538, 540, 340/541, 546, 693

[56] References Cited

U.S. PATENT DOCUMENTS

| | | | |
|---|---|---|---|
| 3,671,760 | 6/1972 | Holmes | 307/116 |
| 3,699,569 | 10/1972 | Lee | 340/409 |
| 4,006,460 | 2/1977 | Hewitt et al. . | |
| 4,401,976 | 8/1983 | Stadelmayr | 340/522 |
| 4,536,747 | 8/1985 | Jensen | 340/502 |
| 4,594,580 | 6/1986 | Nelson | 340/521 |
| 4,665,385 | 5/1987 | Henderson | 340/539 |
| 4,668,939 | 5/1987 | Kimura et al. | 340/521 |
| 4,672,365 | 6/1987 | Gehman et al. | 340/531 |
| 4,733,224 | 3/1988 | Kimura et al. | 340/521 |
| 4,742,336 | 5/1988 | Hall et al. | 340/531 |
| 4,775,853 | 10/1988 | Perez Borruate | 340/521 |
| 4,793,836 | 12/1988 | Griffis | 55/210 |
| 4,818,970 | 4/1989 | Natale et al. | 340/539 |
| 4,908,602 | 3/1990 | Reich et al. | 340/531 |
| 4,993,313 | 2/1991 | Newman et al. | 98/1.5 |

OTHER PUBLICATIONS

Excerpts from catalog of Edwards, A Unit of General Signal, of Farmington, Conn., 5 pages (not numbered) Jan. 1988.

Instruction sheet for 32RBl Relay Adapter Board of SS-32 Security System, of Linear Electronics, Carlsbad, Calif., 4 pages (not numbered) Jan. 1985.

SS-32 Supervised Wireless Applications Manual of Linear Corporation, Carlsbad, Calif., 52 pages (including covers) Jan. 1987.

Installation and Operation Manual for SS-32T Supervisor (Supervised Wireless Security Receiver, of Linear Corp., Carlsbad, Calif., 24 pages (including covers) Jan. 1988.

*Primary Examiner*—Donnie L. Crosland

*Attorney, Agent, or Firm*—Panitch Schwarze Jacobs & Nadel

[57] ABSTRACT

A fully hand portable security system includes a plurality of radio transmitter equipped detectors with batteries, configured to generate one or more radio signals indicating the sensing of a potentially hazardous environmental condition by the detector and a central controller including a weather resistant housing including a radio receiver, a processor and power supply circuitry, operator audible and visible alerting devices and connectors activating or deactivating various optional or other devices at the location and transmitting alarm or other trouble warning message to remote location. The controller is configured to be powered by either AC or DC power supply, including an external, hand portable battery providing a multiday power supply for operating the system for at least one week. Operation of the system is as simple as carrying the components to the area to be protected, hand install the detectors about the area, connecting the controller to the selected power supply and turning the controller on. The preferred system can be configured to automatically initialize itself and to begin surveillance operations. The system is removed by simply picking up and carrying away the detectors and controller after coupling the controller from a power supply, if necessary.

22 Claims, 7 Drawing Sheets

PORTABLE SECURITY SYSTEM

FIELD OF THE INVENTION

This invention relates to security systems and, more particularly, to systems including a central controller and multiple remote detectors interacting with the controller.

BACKGROUND OF THE INVENTION

A number of different types of security systems have been designed or proposed which include a central controller and a plurality of remote sensors designed to respond to a particular, possibly hazardous environmental condition, such as fire, an intruder, explosive or poisonous gas, temperature extremes, radiation, water, etc., or to several such conditions. The central controller monitors the status of the various sensors and sounds an alarm in response to a potentially hazardous condition detected by one or more of the sensors.

The great majority of such systems are designed to be permanently installed with the controller permanently wired to the various sensors and permanently wired into the AC electrical distribution system available at the location.

In some instances, systems have been proposed which include wireless radio links between the sensors and the central processing unit. However, in such systems, the central processing unit, the detectors or both remain hard wired into the AC power distribution system available at the location where the system is installed.

In addition, many of these systems are modular. The central processor may be provided with circuitry for responding to an alarm signal received from a remotely located sensor and, through the provision of separate components may respond to the condition in various ways, such as by activating an audible and/or visual alarm, automatically dialing a remote or central fire fighting or security installation, etc. In the known systems, these components are selectively provided, may be permanently mounted, and are typically hard wired into the controller, a power supply at the location, or both.

The loss of such existing systems, even on a temporary basis, can have significant impact. For example, in some localities, even the temporary loss of a hard wired fire detection system in a hospital requires the hospital to immediately evacuate all patients in areas monitored by the disabled detectors. In many working environments, the loss of sensors indicating the presence of radiation, hazardous or explosive gases or other toxic or dangerous material necessitate immediate shutdown and evacuation of the monitored areas. No known system is capable of being quickly and temporarily installed in such instances without some type of jerry-rigged, hard wire connections between sensors and their controller or any one of them and a power supply.

SUMMARY OF THE INVENTION

In one aspect, the invention is a portable security system which comprises a plurality of hand portable detectors and a hand portable central controller. Each detector includes a sensor configured to generate a signal having a state related to a state of a predetermined environmental condition monitored by the sensor, a radio transmitter circuit, a processor circuit configured to generate and pass to the transmitter circuit for transmission, an alarm report signal to indicate occurrence of a sensed potentially hazardous state of the predetermined environmental condition, and a self-contained power supply configured to independently operate the detector. The hand portable controller includes a housing containing a radio receiver circuit, a processor circuit configured to decode a received alarm report signal and to identify the detector of the plurality transmitting the signal, and a power circuit configured to operate at least the processor and radio receiver circuits from either one of an AC and a DC power source.

In another aspect, the invention is a portable central controller for such a portable security system which comprises: a hand portable housing; a radio receiver circuit within the housing; a processor circuit within the housing configured to analyze radio signals received by the receiver circuit to identify an alarm report signal transmitted by any of a plurality of separate, radio signal transmitting detectors and to identify the detector of the plurality transmitting the alarm report signal; and a power circuit in the housing configured to selectively power the controller from either of a DC power source and an AC power source external to the housing.

In yet another aspect, the invention is a portable central controller for a portable security system comprising: a hand portable housing; a radio receiver circuit within the housing; a signal processor circuit within the housing configured to decode radio signals received by the receiver circuit to identify an alarm report transmitted by any of a plurality of separate, radio signal transmitting detectors and to identify the detector of the plurality transmitting any alarm report signal identified; and multi-conductor connector means coupled with the power supply circuit and accessible from outside the housing for releasably coupling the controller with a power source connector external to the housing.

In yet another aspect, the invention is a method of providing temporary security monitoring over an extended area which comprises the step of: carrying a plurality of individual detectors and a central controller to the area. Each detector is hand portable and includes a sensor, a radio transmitter circuit, and a self-contained power source for independently powering the detector. The central controller is hand portable and includes a housing containing a radio receiver circuit, a signal processing circuit coupled with the receiver circuit, and a power circuit coupled with the processor circuit, the radio receiver circuit and a multi-conductor connector at least partially exposed on the outside of the housing. The method further comprises the steps of installing the plurality of detectors by hand about the area to be protected and locating the controller within range to receive radio signals transmitted by each of the detectors. The method further comprises the step of releasably electrically coupling the central controller through the connector with either one of an AC power supply and a DC power supply at the location.

In a further aspect, the method further comprises the steps of gathering up the distributed detectors, uncoupling the portable central processor from the power supply, and carrying away the plurality of detectors and unplugged central processor to remove the system from the central area.

BRIEF DESCRIPTION OF THE DRAWINGS

The foregoing summary as well as the following detailed description of preferred embodiments of the invention will be better understood when read in conjunction with the appended drawings. For the purpose of illustrating the invention, there is shown in the drawings, embodiments which are presently preferred. It should be understood, however, that the invention is not limited to the precise arrangements and instrumentalities shown. In the drawings.

DETAILED DESCRIPTION OF THE PREFERRED EMBODIMENT

Figures 1, 8:
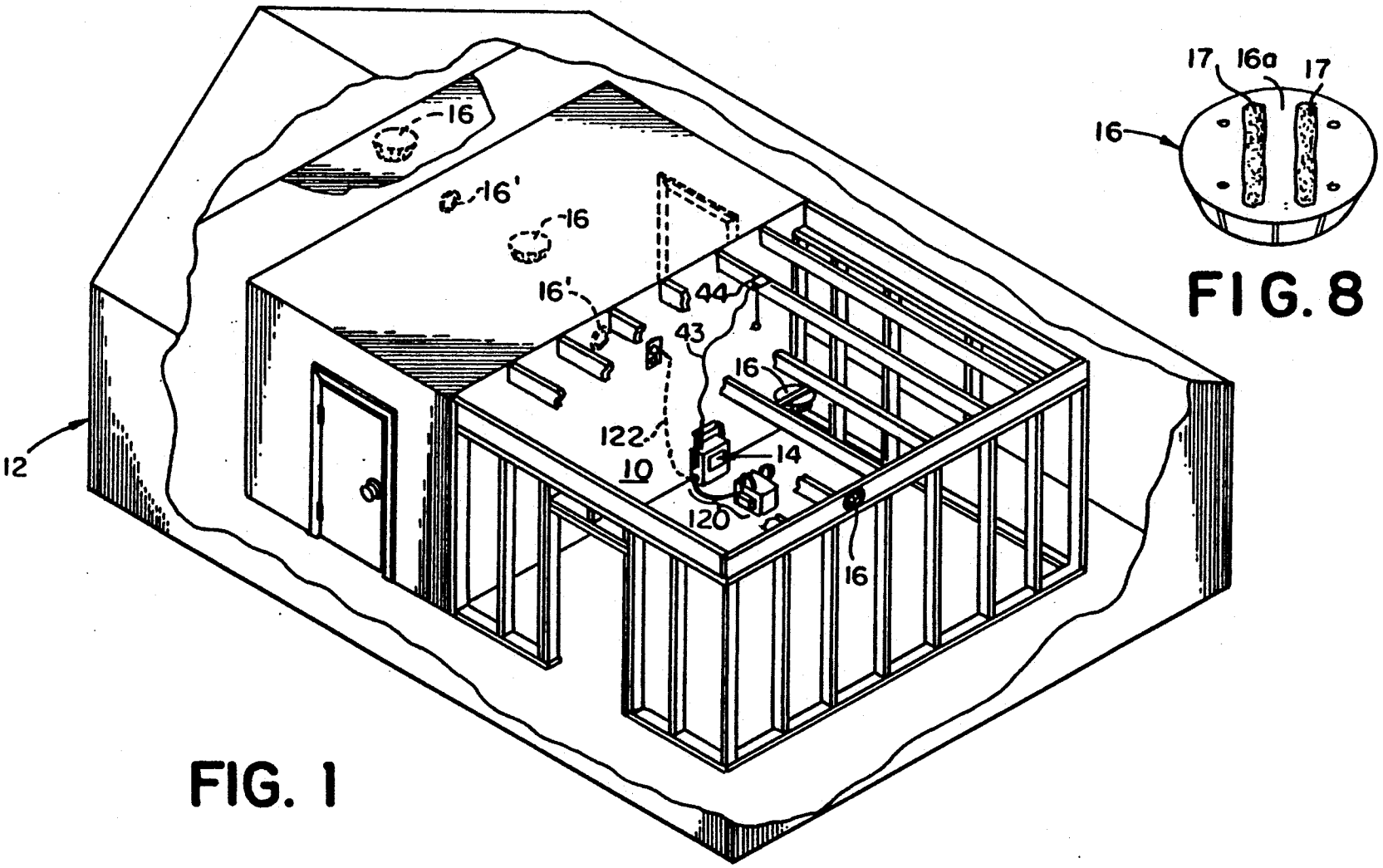
FIG. 1 depicts diagrammatically the installation of a preferred portable security system of the present invention at a protected location.
FIG. 8 depicts diagrammatically a portable, radio transmitting detector used with the system of the present invention.

In the drawings, the same numerals are employed to indicate the same elements. FIG. 1 depicts a simplified diagrammatic view of an installation of a preferred portable security system of the present invention at an extended area indicated generally at 10, to provide temporary security monitoring to the area 12 to be protected by the system 10. Area 12 might be, for example, part or all of a building having need of the system on a temporary basis, such as during initial construction when a permanently installed security system is not available or during renovation when an existing security system has been removed or when an existing system is disabled. The area to be protected may also be outdoors as well as indoors or both.

The system 10 of the present invention preferably comprises a hand portable controller 14 and a plurality of separate, hand portable, independently powered and operating, radio signal transmitting detectors 16. The controller 14 and detectors 16 are sufficiently compact and light to permit them to be hand carried to the area for installation, are preferably temporarily installed by hand by attachment to various parts of the protected building 12, for example, to studs or joists, ceiling or any other suitable support for the detector being used, throughout the area 12 being protected. The particular placements of the controller 14 and individual detectors 16 are critical only in the conventional sense that the detectors 16 should be located where they can properly perform their surveillance or monitoring function and where the controller 14 can receive radio transmissions from each of them.

The preferred system being depicted in FIG. 1 may be, for example, a fire detection system. Each of the detectors 16 incorporates as a self-contained power source, such as a dry cell battery. The detectors 16 each further include a sensor configured to generate a signal having a state related to a state of the predetermined environmental condition being monitored, such as a fire or smoke-activated sensor, and a radio transmitter circuit configured to transmit an alarm report signal preferably encoded to provide various information including but not necessarily limited to an identification of the individual sensor transmitting the report. Preferably, the detector includes its own processor circuit and generates an alarm report signal transmitted by the detector 16 if it has sensed the potentially hazardous environmental condition(s) or one of the conditions it is designed to sense, for example, smoke and/or temperature. The alarm report signal may be encoded to indicate it is an alarm report and to distinguish it from one or more other types of signal which the detectors may be configured to generate and transmit. Both the controller 14 and detectors 16 of the present invention are preferably designed to be entirely hand portable in ways which will become clear from the following discussion of their construction and use.

Figure 2:
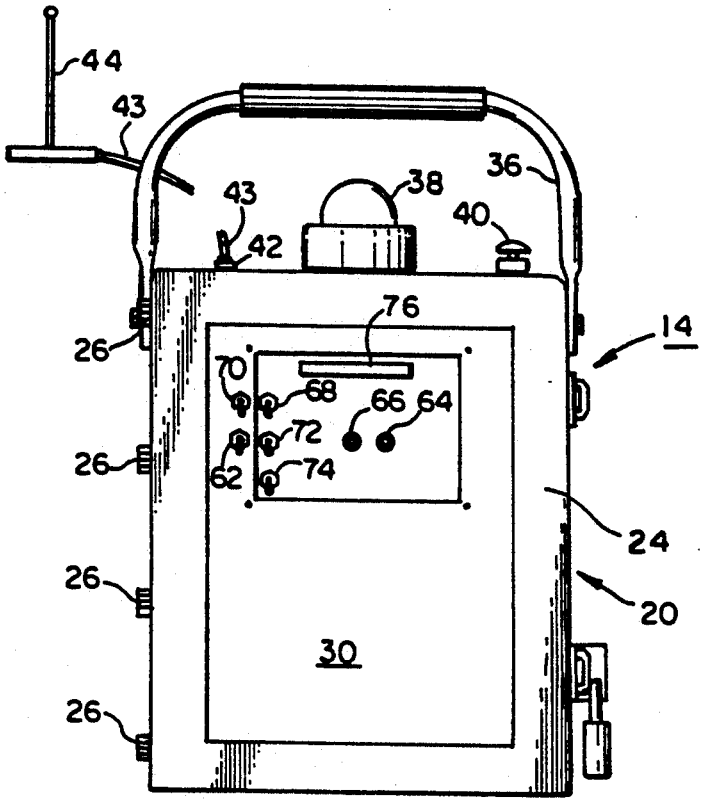
FIG. 2 is a diagrammatic front elevation view of a preferred portable central controller of the system of FIG. 1.
Figure 3:
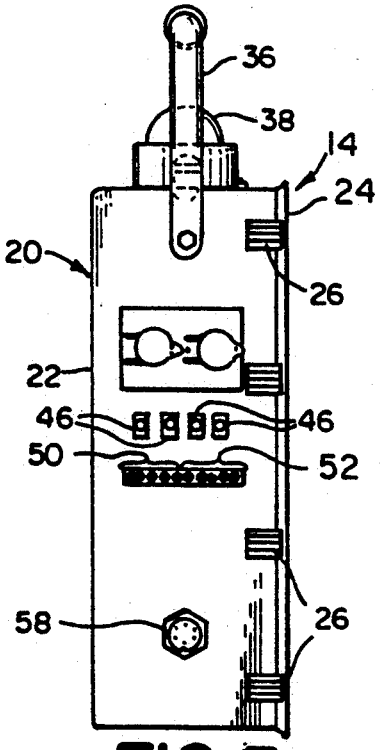
FIG. 3 is a diagrammatic view of the left side of the controller of FIG. 2.
Figure 4:
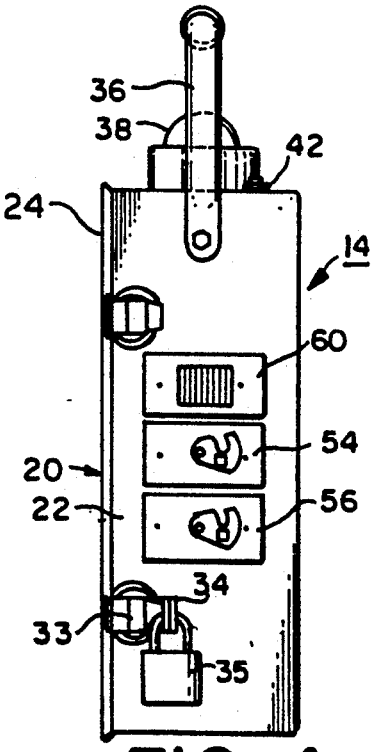
FIG. 4 is a diagrammatic view of the right side of the controller of FIG. 2.

Referring to FIGS. 2 through 4, hand portable controller 14 preferably includes a housing indicated generally at 20. Housing 20 preferably includes an open sided box portion 22 and an access door or cover 24 mounted by hinges 26 to the box covering only open side. Preferably the cover 24 includes a transparent window 28 which provides a view of a portion of an interior front panel 30 within the housing 20. Preferably, housing 20 is formed from electrically insulative (dielectric) material. For example, the box portion 22 and cover 24 may be formed of fiberglass while the window 28 is formed from clear Plexiglass®. Preferably, gasketing (not depicted) is provided between the box portion 22 and cover 24 and provided at each other opening through the walls of the housing 20 to weatherproof the housing 20 by rendering it at least water resistant. The cover 24 may be secured shut by releasable clip fasteners (not depicted) or locked, for example, with a hasp 33, latch 34 and padlock 35. Preferably, a single, large, U-shaped handle 36 includes a pair of opposing arms which are fixedly fastened to the box portion 22 of the housing 20 on the opposing sides of the box 22. The handle 36 permits the controller 14 to be easily lifted and moved. Preferably, a visual alarm condition indicator in the form of a strobe light 38 is fixedly secured to the box portion 22 on what is preferably the top wall of the housing 20. Preferably, an emergency switch 40 is also fixedly mounted to that wall of the housing 20. Lastly, an antenna connector 42 is further fixedly mounted to that wall of the housing and receives a mating connector **42*b* at one end of an about twelve-foot length of cabling 43 with an antenna member 44** at its remaining end.

Referring next to FIG. 3, preferably fixedly mounted to the box portion 22 through the left side wall of the housing 20 are four identical, circular receptacle-type connectors **46*a*. Each provides a pair of wire connections to and from a relay 45 located within the housing 20. Also preferably provided are a pair of three pin terminal block connectors 50 and 52 for external alarm and trouble signal connections, respectively. A pair of conventional, three hole AC receptacles are preferably provided with weather covers in an assembly including a ground fault interrupt circuit, all collectively indicated at 48. Lastly, an external multi-conductor, plug-in type power supply connector 58 is provided coupled to circuitry within the controller 14**.

Referring now to FIG. 4, an audible alarm condition indicator, preferably in the form of a siren 60, is preferably provided on the right side wall of box portion 22 of the housing, together with a pair of covered, conventional telephone jack connectors 54 and 56.

Referring back to FIG. 2, interior front panel 30, which might be multipiece as depicted, further preferably mounts a "trouble" indicating yellow LED 64, a power ON/OFF indicating green LED 66, an alarm acknowledge switch 62, a "reset" switch 68, a power ON/OFF switch 70, a "program" switch 72, a "mode" switch 74 and a sixteen character, alphanumeric liquid crystal display (LCD) unit 76.

Figure 5:
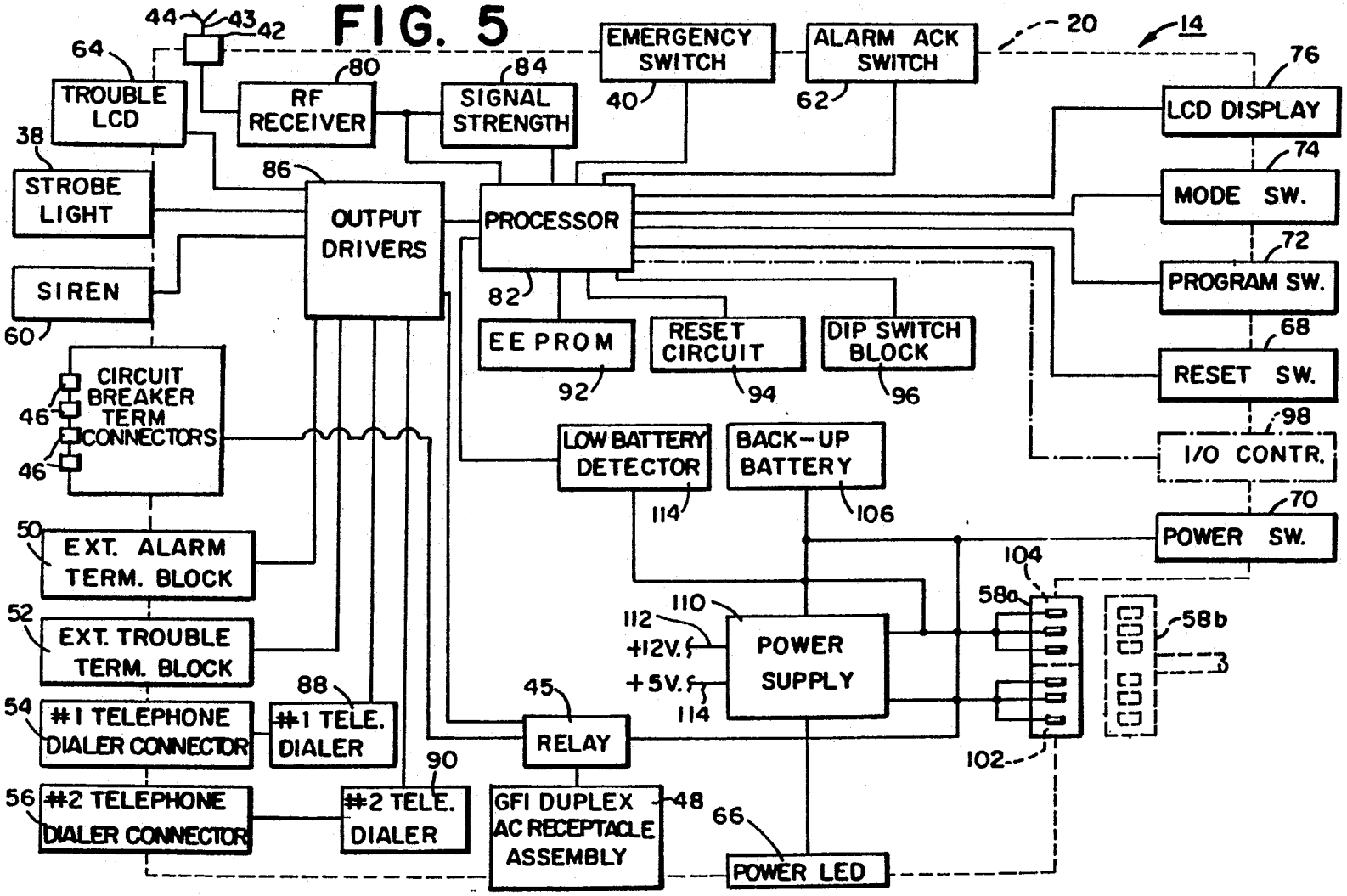
FIG. 5 is a block diagram of the major subcomponents of the portable controller of the preceding figures.

Referring now to FIG. 5, there is shown in block diagram form, the major electrical components of the controller 14. In addition to the components and connectors already noted, the controller 14 includes a radio frequency ("RF") receiver circuit 80 the output of which is passed directly to a processor circuit including a microprocessor 82 and to a signal strength detection circuit 84. Circuit 84 responds to the strength of the received radio signal to output a bi-level signal to the processor 82 indicating whether the RF signal is of adequate strength or too weak. The RF signal may be too weak for a number of reasons, including the detector 16 in question being out of range of the controller 14 or interference between the detector and the controller. A plurality of output drivers 86 are suggestedly provided on a single chip. The drivers 86 are controlled by the processor 82 and power the strobe light 38, siren 60, trouble LED 64, the external alarm and trouble signal terminal blocks 50 and 52 and trip relay 45 and relays in telephone dialers 88 and 90. Preferably, one dialer 88 is a digital communicator for transmitting a digital signal and the other is a tape player providing an audible message.

The processor 82 operates in accordance with a program stored on an associated virtual memory (not separately depicted). The virtual memory is preferably provided with a CPU and other conventional components on a single chip to form the processor 82. The processor circuit includes separate data storage, preferably a EEPROM 92, preferably provided to maintain the status data of the system. Also, optionally but preferably included with the processor circuit is a reset subcircuit 94, coupled with the processor 82, to monitor its operation and to reinitiate the operating program should the processor 82 fail to communicate or respond in a expected manner with subcircuit 94.

Preferably, the controller 14 is provided with means for uniquely coding its identity so that several of the preferred systems 10 might be set up in close or overlapping proximity yet independently operated. In the disclosed preferred embodiment, a block or assembly 96 of individual DIP switches is provided to manually input an identification code of, for example, eight bits, to uniquely identify the controller 14. Lastly, a serial input/output controller subcircuit 98, also known as an RS 232 serial communicator, optionally may be coupled to a communication port of the processor 82 for additional external communication with the processor 82, if desired.

Important to the present invention are the provisions made for powering the controller 14 selectively from any of a variety of sources. Referring to FIG. 1, controller 14 is shown coupled to a portable, external, preferably at least seven day power supply, indicated generally at 120. Selective alternate connection to an AC power source in the area 12 can be provided as is indicated in phantom at 122, by the provision of a length of multi-conductor cable appropriately wired to a mating receptacle type connector **58*b* at one end and a conventional multipin, AC plug connector, 110 volt, for example, in the U.S. External power connection to the controller 14 is provided through connector 58*a*, which is preferably a six pin, plug type circular connector, such as a Mil Spec 3106 straight connector, having a polarizing keyway. Three of the pin/conductors indicated at 102 are dedicated for coupling the controller through a mating receptacle type connector 58*b* to a conventional, 110 volt AC power source at the location while the remaining three pin/connector combination 104 is dedicated for connection through an appropriately wired connector 58*b* to the external 12 volt DC power supply 120. In addition, a twenty-four hour backup battery 106 is preferably provided within the controller 14 to maintain the operation of the controller 14** for at least a short period of time in the event of external power loss.

Each set of pin/conductors 102 and 104 and the backup battery 106 are coupled with a power supply circuit 110 which rectifies, adjusts and regulates the AC power or adjusts and regulates the DC power, respectively, to approximately twelve volt and five volt DC levels, and supplies those resulting DC levels along power output lines 112 and 114 to the remaining electrical components of the controller 14. A low battery detection circuit 116 is preferably provided to monitor the voltage and to output a high/low signal to the processor 82 if that circuit 116 detects a voltage level within the controller which is less than a desired minimum voltage level, typically indicating the weakening of whichever DC source 104 or 106 may be powering the controller.

Figure 6:
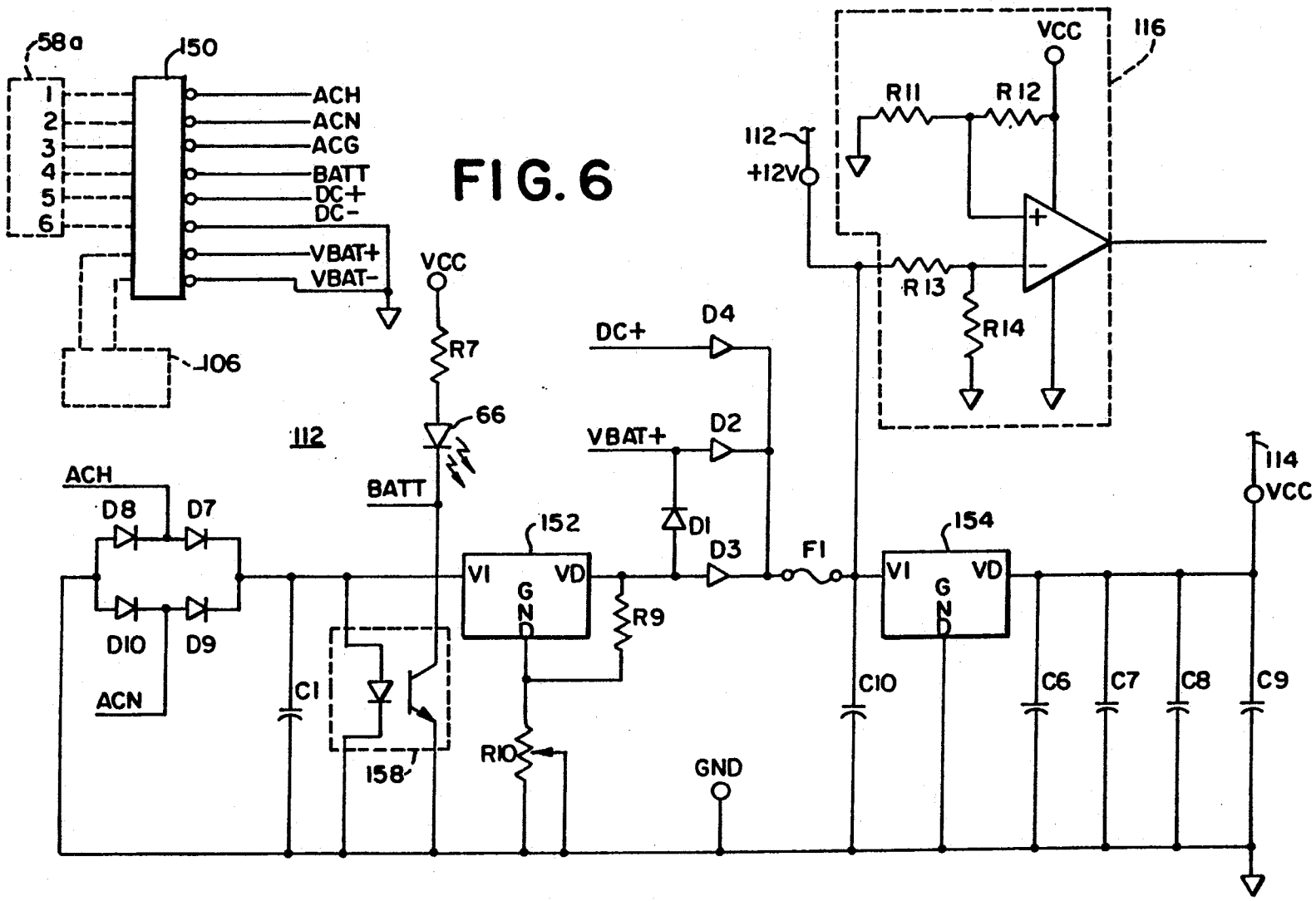
FIG. 6 depicts schematically a power supply circuit and a low battery circuit in the controller.

Referring to FIG. 6, there is shown schematically details of the preferred power supply circuit 110 and low battery detector circuit 114, together with various connections to the external connector **58*a*, back-up battery 106, power LED 66, and low-battery detector subcircuit 116. Junction block 150 provides a point of common connection for the six conductors provided through connector 58*a* and a pair of conductors provided from the back-up battery 106. The eight output lines are identified. Briefly, the hot and neutral AC power source lines from connector 58*a*, ACH and ACN, respectively, are rectified through an array of diodes D7 through D10. The resulting rectified DC signal is smooth with capacitor C1 and applied to input of V1 of an adjustable voltage regulator 152 preferably adjusted to provide approximately a +13.8 VDC level at output VD and at the "+12 V" supply node coupled with supply line 112. The positive side of the internal back-up battery 106 and of any external battery coupled to the controller through connector 58*b*, VBAT+ and DC+, respectively, are coupled through diodes D2 and D4, respectively, to the +12 V level line between output VD of element 152 and the +12 V supply node. The +12 V level signal is applied to input VI of a second voltage regulator 154, providing an approximately +5 VDC level signal at output VD and at node VCC coupled with line 114. Branches of the +12 V and VCC signal lines are carried to the low-battery detector subcircuit 116. There amplifier 156 is configured as a comparator and compares signals based on both the nominal +5 V (VCC) signal and nominal +12 V signal developed within the power supply circuit 112 so that, if the difference between the levels is insufficient, a high level signal is output to the processor from amp 156, indicating an inadequate supply of power to the power supply circuit 110**.

The coupling of an external power supply to the controller 14 through the connector 58 is signaled through the power LED 66 in either of two ways. Where an external AC power supply is coupled through connector 58*a* to the controller, opto isolator element 158 draws current through the LED 66. When an external DC power supply is coupled to the controller through the connector 58*a*, line BATT from junction block 150 is connected with system ground, providing an alternate path for current through the LED 66. The function of the remaining individual diodes, resistors, capacitors, and fuse will be apparent to those of ordinary skill in this art.

Preferably, each of the detectors 16 is configured to generate and transmit preformatted digital signals reporting any of five different conditions. Preferably, each detector will transmit an alarm condition or alarm report signal whenever a potentially hazardous state of an environmental condition being monitored by the sensor(s) of the detector 16 is sensed. "Alarm report" and "alarm condition" will be used interchangeably. Each detector 16 also preferably generates and transmits a restore report signal whenever the sensor(s) no longer senses the potentially hazardous state of the condition(s) after transmitting an alarm report. Each detector 16 preferably also transmits a low power report signal indicating that its internal DC battery power supply has fallen below a predetermined level. Each detector also preferably transmits a test report signal when the detector is manually triggered by an operator. Lastly, each detector also preferably transmits at regular, predetermined intervals, a status report signal to indicate to the controller 14 that the detector 16 is still on-line and operating.

In a fire detection configuration, the preferred detectors are Electro Signal Lab, Inc. 371 Series battery powered photoelectronic smoke alarms distributed by Electro Signal Lab of Hingham, Mass. 02043. The detectors sense smoke to determine a possible fire condition and transmit a three-second alarm report signal which is repeated at thirty-second intervals for as long as the alarm condition exists. Each detector 16 is also configured to transmit restore report signals when the sensor returns to its normal, nominal state, a low battery report if the enclosed drops to 7.5 volts or less and a test signal when a test button provided on the detector is depressed. Status signals are generated and transmitted on a sixty-minute cycle. Each of the preferred detectors is further provided with a pair of DIP switch arrays used to set the code of the system controller and a unique code identifying the individual detector and certain of its characteristics. All of the digital signals are of the same format with individual bits allocated to distinguish among alarm report, restore, test, low battery and status report signals. Each signal is further encoded with a plurality of bits (for example, five) allotted to individual sensor identification and with yet another plurality of bits (for example, eight) allotted to controller identification. The latter permits the operation of overlapping systems 10.

Figure 7A:
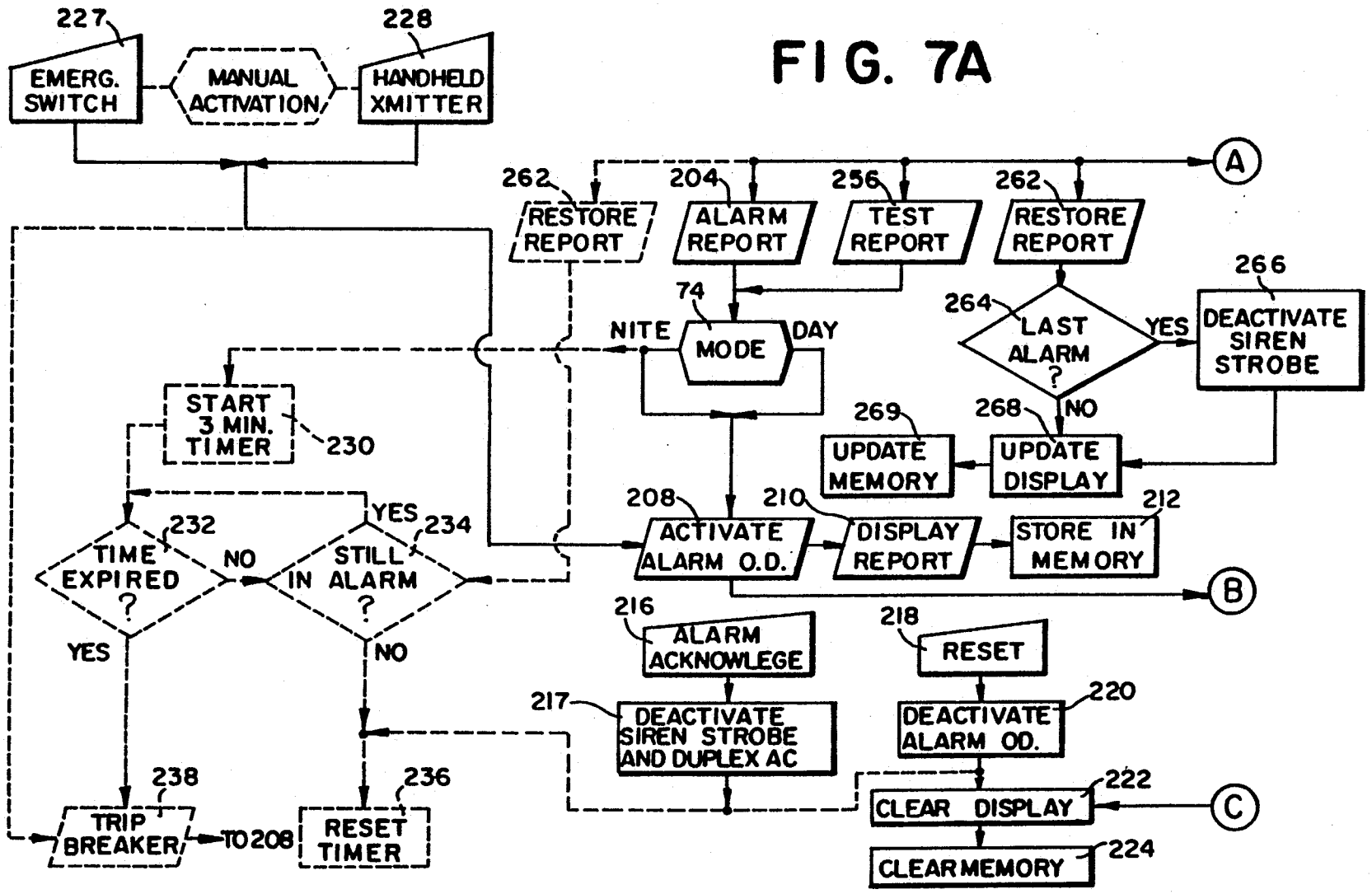
FIGS. 7A and 7B are a block diagram of the operation of the portable controller of the preceding figures.
Figure 7B:
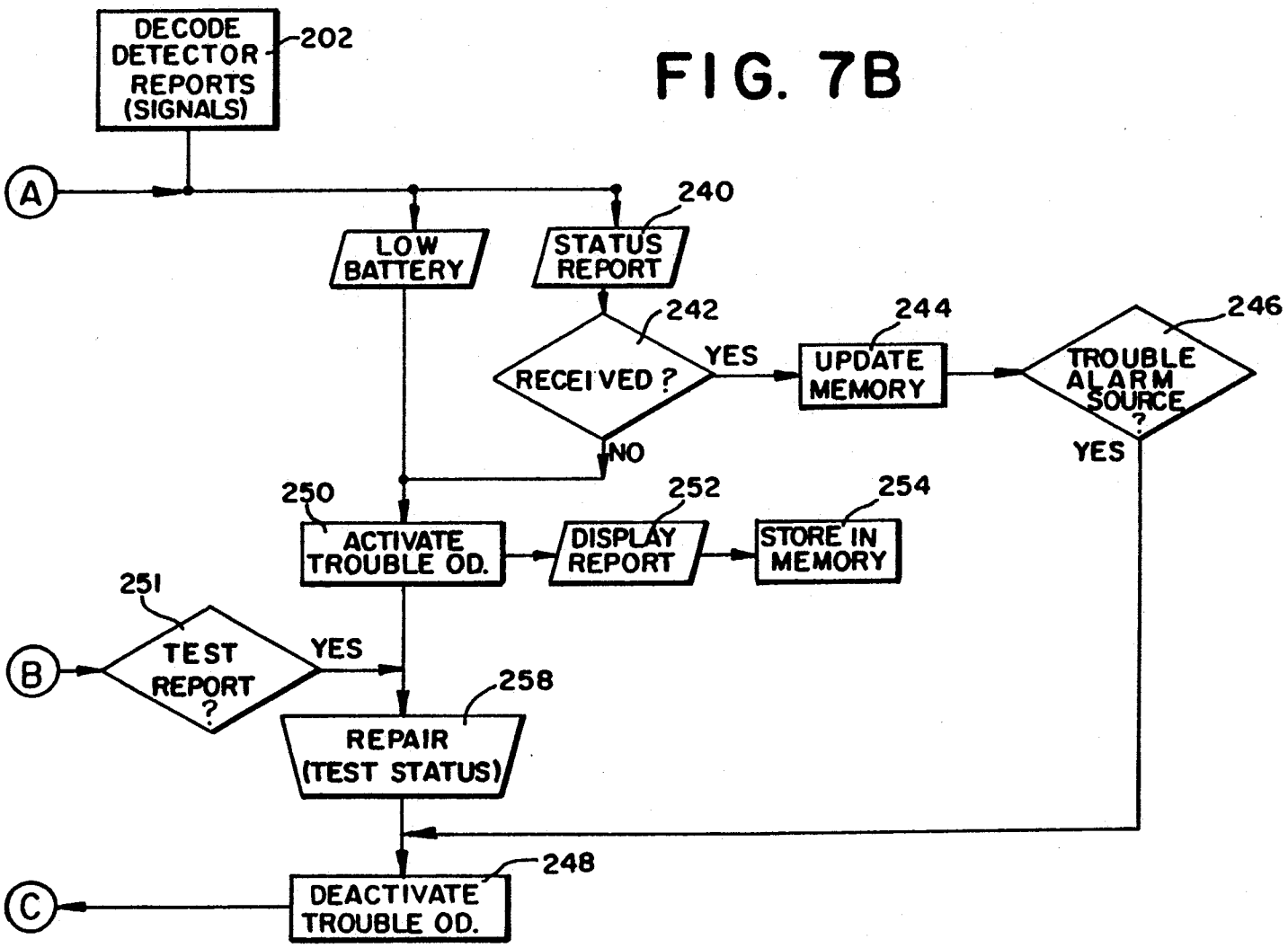

FIGS. 7A and 7B depict diagrammatically the steps of the controller 14 under the direction of the processor 82 and its operating program in response to the various alarm, restore, test, low battery and status report signals and to the failure to receive a scheduled status report signal. Receiver circuit 80 receives and demonstrates digital radio signals from the various detectors 16 and forwards the demonstrated digital signals to the processor 82. The processor 82 decodes each digital signal and classifies each signal it receives at step 202.

When processor 82 identifies an alarm report signal at step 204 from a remote sensor 16, it responds in different ways, depending upon the state of the controller "mode" switch 74. If the switch 74 is set to a "daytime" mode, the processor 82 transmits a control signal to the alarm output drivers 86 which activate the strobe 38 and the siren 60 at step 208. All are operated continuously after an alarm report. At step 210, processor 82 further generates and displays on the LCD unit 76, a report indicating the existence of an alarm and the identification member of the detector 16 transmitting the alarm signal. At step 212, processor 82 further updates the EEPROM 92 to store the alarm report and the identification of the detector 16 transmitting the alarm report. The processor 82 further activates the output drivers 86 in step 208 for activating the external alarm terminal block 50 and, where provided, one or both phone dialers 88 and 90. The strobe and siren will continue to operate until the processor 82 senses the depression of the alarm acknowledge switch 62 at step 216, at which time the strobe and siren are turned off at step 217 and the emergency duplex AC receptacles 48 are disconnected from power supply circuit 110. When the processor 82 senses depression of reset switch 68, all activated alarm and/or trouble output drivers 86 are deactivated. When the processor senses the depression of the "reset" switch 60 at step 218, it further clears all alarm and trouble reports from the LCD 76 at step 222 and all records of alarm and trouble reports in the EEPROM 92 at step 224.

If the "mode" switch 74 is in the "NITE" state, steps 208, 210 and 212 are immediately performed and a three-minute timer is also started in the processor 82 at step 230. The status of the timer is monitored at steps 232 and 234 by the processor during each cycle of the operating program until the timer times out or a restore report is received at 262, cancelling the last (or only) alarm. Depression of either the alarm acknowledge switch 62 or the reset switch 68 before the timer times out also causes the processor to skip step 238. If the system is still in an alarm state after the three minute period has expired, processor 82 transmits a control signal to the output driver 86 tripping the relay 45. Relay 45 trips all circuit breakers connected to the controller through connectors 46*a* and couples an external AC power supply, if being used by the controller, to the duplex receptacles 48.

The preferred controller 14 is also configured to respond to manual alarm reports inputted through emergency switch 40 on the controller 14 at step 227 or through a portable, handheld transmitter (not depicted), which might be activated by a system operator or other individual at the protected location, at step 228. Preferably, the handheld transmitter transmits an encoded signal received and processed like detector report signals but encoded to identify it as originating from the handheld transmitter. Preferably, the controller 14 is configured to respond in the same way to a manual alarm report from either source as it responds to detector alarm reports in the daytime mode of the controller, regardless of the state of the mode switch 74 when the manual activating signal is received, except that the relay 45 is tripped at step 238 immediately upon receipt of either type of manual alarm report.

The processor 82 monitors and times the receipt of status report signals regularly transmitted from each detector 16. The processor 82 determines at step 242 whether or not a status report is due and, if due, whether it has been received from each detector 16 within the allocated predetermined time for providing such reports. Where a status report is successfully received, the processor 82 updates the status of that detector in the EEPROM 92 at step 244. Processor 82 determines at step 246 whether the detector transmitting the received status report was the source of a trouble indication. If so, the processor 82 deactivates the trouble indicating output drivers (siren, LED and external terminal blocks 52) at step 248 and clears the display and EEPROM of the trouble report at steps 224 and 226, respectively. If there are other sources of trouble (low battery reports, missed status reports), the visual and audible trouble indicators (siren and LED) will remain activated and all remaining alarm and trouble conditions displayed on the LCD unit and retained in the memory. The processor 82 then returns to decoding detector reports at step 202. If a status report is not received within the period when such report should have been received, the processor 82 responds at step 250 by activating the appropriate trouble indicating output drivers to activate the trouble signal terminal block connector 52, the trouble indicating LED 64 and the siren 60, the latter two in an intermittent manner. At step 252, the processor 82 also generates and displays an appropriate trouble report on the unit 76 and stores information concerning the lack of a status report and the affected detector in the EEPROM 92.

When the processor 82 receives a test report signal from an operator at the detector in question at step 256, indicating the detector is again ready for service, or if it subsequently receives a status report signal, the processor resets the controller by turning off the siren 60 and extinguishing the trouble indicating LED 64 at step 248, and clearing the LCD unit at step 224 and the EEPROM memory at step 226 of the trouble message and report. The system goes back to a nominal state with the processor 82 again monitoring for the regular occurrence of status reports at step 202 and decoding other report signals.

When one of the preferred detectors 16 has sensed the potentially hazardous, environmental condition it was designed to monitor and transmitted an alarm report but no longer senses the potentially hazardous condition, it generates and transmits a restore report. When the processor 82 receives a restore report at step 262, it determines if the restore report clears the system of all alarms at step 264. If there are no more pending alarms, the alarm output drivers are deactivated. In each case the display and the memory are updated at steps 268 and 269 to reflect the receipt of the restore report. When all detectors are restored from alarm condition, the display and memory can be cleared by pressing the reset switch.

A test report is transmitted from a preferred detector 16 when a test button on the detector 16 is depressed. When a test report signal is identified at step 256, the processor responds somewhat similarly to the way it responds to an alarm signal. A test report signal 256 is treated initially like an alarm report signal and causes the processor to activate the alarm siren and strobe indicators to generate an appropriate message appearing in the display unit and store a report of the test signal in the EEPROM memory at steps 208, 210, and 212. Moreover, the processor determines at step 257 if the test report was received from a detector 16 generating an outstanding alarm or trouble condition. If so, the trouble/alarm visual and audible indicators are reset at step 248 and the display and memory cleared at steps 222 and 224 of the trouble conditions.

In the event that multiple alarm report signals are received from several of the detectors 16, the processor 82 is preferably programmed or otherwise configured to store and maintain each of the alarm reports in the EEPROM and to display in the LCD unit a message identifying each detector in an alarm condition in the order such alarm report signals are received, until all alarm conditions are resolved by automatic restoration of the detectors when the environmental condition which has caused the alarm has passed or been corrected or until the entire system is reset manually through the reset button 68. In the event that multiple problems are reported (alarm(s), low battery(-ies), and/or no status report(s)), the processor 82 is preferably preprogrammed to cycle through the multiple problems reported as long as such multiple problems continue to be reported or continue to exist. The processor 82 may cyclically display multiple alarm and/or trouble reports at a rate of, for example, about ten reports per minute to keep the operator fully informed of all outstanding problems. Preferably, the processor 82 is configured to cyclically display alarm report signals in the order received so that the operator may determine a path that a spreading or moving potential hazard has taken.

Referring to FIG. 8, the preferred fire detectors 16 and other, similar detectors typically include one or more holes through a back plate which permit the detector to be mounted against a ceiling or other supporting wall or member by fasteners (e.g., nails, screws, hooks, etc.) passed through the hole(s). To further improve upon the portability of the monitoring system of the present invention, one or more layers 17 of contact adhesive may be provided on the rear, mounting wall **16*a* of the detector 16 as shown in FIG. 8, to additionally enable the detector 16 to be adhered to a supporting surface thereby dispensing with the need for mechanical fasteners to position the detectors. The contact adhesive may be provided by a two-sided tape having a contact pressure adhesive on each side, one adhesive side being secured to the rear, mounting face of the detector 16** and the opposing side covered by a release strip for protecting the adhesive until the detector is mounted to a support surface after the release strip is removed.

Figure 9:
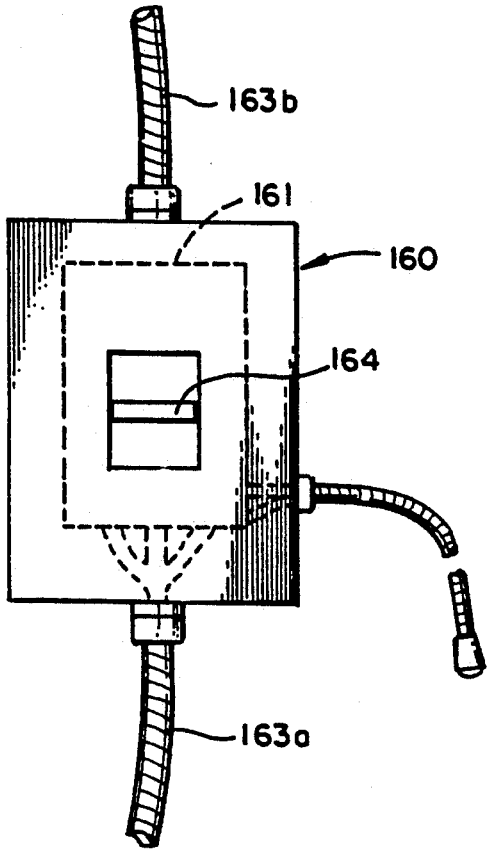
FIG. 9 depicts diagrammatically a shunt trip circuit breaker optionally provided for use with the system.

FIG. 9 depicts an optional, remotely operable, circuit breaker assembly 160 which includes a convention AC circuit breaker mechanism indicated diagrammatically, in phantom at 161, rated to 240 volts and 100 amps in a housing 162. Separate halves **163*a*, 163*b* of a power supply cable are connected across the circuit breaker 161. A manually operable handle 164 is provided through an opening on one side of the housing 162 to switch off, switch on and reset the circuit breaker 161. A length of flexible cable 165 includes a plug-in type connector 46*b* which is configured to releasably mate with any of the circuit breaker connector 46*a* exposed on the housing of the controller 14. Cable 165 is preferred for the connectors 46*a*/46*b* selected, but any cabling including two or more conductors would be suitable. The assembly 160 is configured to shunt trip with the neutral lead of AC cable 163***a* from the AC source coupled to one side of the circuit breaker 161 and one of the hot leads of cable 163*a* coupled through the two conductors in a cable 165 and relay 45 in the controller to the other side of the circuit breaker. In this way, up to four separate AC power supply cables 163 can be controlled using their own current to automatically cut power to lighting, operating equipment, etc., when an alarm condition exists.

Figure 10:
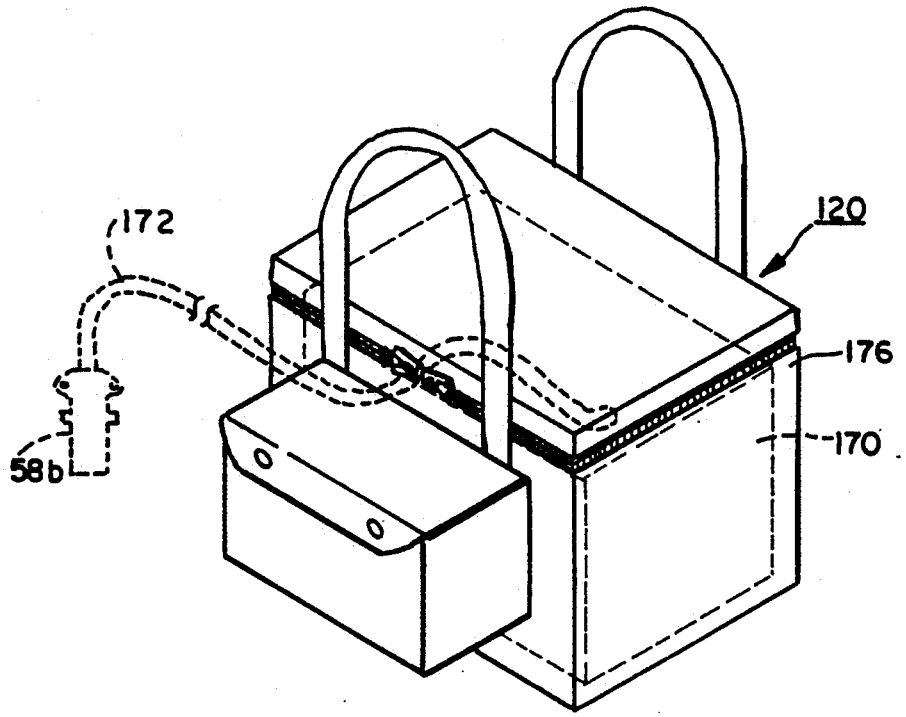
FIG. 10 depicts diagrammatically a hand portable DC power supply optionally provided for powering the controller for several days.

FIG. 10 depicts a hand portable, external, multiday DC power supply, indicated generally at 120, which preferably comprises a rechargeable lead acid, sealed battery 170 (in phantom), which is releasably coupled by means of a three conductor flexible cable 172 and connector 58*b*, with the controller 14 through the power supply connector 58*a*. Connector 58*b* is configured to polarizingly mate with connector 58*a* and couple the poles of the battery 170 across two of the three conductors 102 in the connector 58*a* dedicated to external DC power supply connection. A carrier case 176 is preferably supplied for ease of movement of the battery 170 and its associated cable 172 and connector 58*b*.

Back-up battery 106 conforms with the requirements of National Fire Prevention Association Standard 72A entitled "Installation, Maintenance and Use of Local Protective Signalling Systems", that the back-up battery be sized to power the controller 12 for twenty-four hours in a monitoring mode and to thereafter have sufficient remaining capacity to operate the controller for five more minutes in a full alarm mode. Preferably, the external DC power supply connection is similarly selected to have a capability for powering the controller for at least several days, preferably at least seven full days, in a monitoring mode and still have sufficient remaining capability to power the controller in a full alarm condition for five minutes following seven full days of monitoring operation. Preferably too, the external DC power supply battery 170 is rechargeable and is capable of providing sufficient power to meet these requirements after multiple recharges. The presently preferred external DC battery 170 provides at least twelve ampere-hours of rated capacity. The remainder of the system 10 preferably conforms to the NFPA Standard 72A.

The following major circuit components and elements can be used as or in the indicated components of the controller:

| Part | Model | Source |
|---|---|---|
| RF receiver 80 | R-5V RF modulator | Linear Corp., Carlsbad, CA |
| twelve-volt output drivers 86 | ULN2803 | Sprague Electronics |
| microprocessor 82 | 87C51CBN40 | Signetics |
| reset subcircuit 94 | DS1232 microprocessor monitor | Dallas Semiconductor |
| LCD 76 | DMC16128UE | Optex |
| EEPROM 92 | 93C46 | SGS Thompson |
| Serial I/O communicator 98 (RS 232 serial communication module) | LT1080 | Linear Technology |
| telephone dialers: | | |
| 88 (digital communicator) | 5107 | Silent Knight |
| 90 (tape) | 49-433 | Radio Shack |
| external power connector 58 | MS3102A | Amphenol |
| circuit breaker connectors 46a | D3M | Switchcraft |
| circuit breaker connector 46b | A3F | Switchcraft |
| external battery 170 | PS12120 (sealed, lead acid) | Power Sonic |
| internal battery 106 | PS-1219 | Power Sonic |
| Schottky rectifier D1-D4 | IN5821 | Diode, Inc. |
| Power LED 66 | HLMP4719 | HP |
| Trouble LED 64 | HLMP4740 | HP |
| Diodes D7-D10 | 1N4005 | GI |
| +5 VDC Regulator 154 | MC7805C | Motorola |
| Adjustable Regulator 152 | LM317 | NSC |
| OPTO Isolator 158 | MCT2 | GI |
| Operational amp 156 | LM358N | TI |
| LCD 76 | DMC16128UE | Optex |
| 10K ¼W 1% R13 | RQ010.0K | TRW |
| 1.2K ¼W 5% R7 | RQF1.2K | TRW |
| 2K ¼W 5% R8 | RQF2K | TRW |
| 240 OHM ¼W 5% R9 | RQF240 | TRW |
| 4.7K ¼W 1% R11, R12 | RQ04.70K | TRW |
| 2.7K ¼W 1% R14 | RQ02.70K | TRW |
| 2K POT R10 | 3386C-1-202 | Bourns |
| 2200UF 25V AXIAL | SM25-T2200 | Unchemcon |
| 22UF 16VDC C6 | TAP226K016CCS | AVX |
| .1UF 50VDC C7-C9 | SR215E104MAA | AVX |
| .22UF 50VDC C10 | SR215E224MAA | AVX |
| relays 88, 90 | SZ-12 | ITT |
| relay 45 | RM702012 | Shrack |
| DIP switch assembly 96 | DB08 | C & K |

Use of the system is straightforward. The components 14 and 16 can be hand carried to the location to be monitored by the system 10. The controller 14 is powered by connecting it to a conventional 60 Hz, 110 volt AC socket, for example, by means of AC extension cord 122 or to the portable DC power supply 120 by its cord 172. The access code DIP switch assembly 96 is set to a desired controller code, if the code is not already preset. The DIP switch assemblies of each detector 16 to be deployed are similarly set to the same controller code and to individually identify that detector. The controller 14 is activated through the ON/OFF switch 70 and initialized by setting the program switch to the ON setting. Each deployed detector 16 is programmed into the controller by depressing its test switch to generate a test report signal. This is done sequentially for each deployed detector. Once entered into the system, the processor 82 looks for a status report at regular intervals (for example, one hour) after the detector 16 was first programmed into the controller 14. Alternatively, the detectors 16 can be simply switched on sequentially, installed and allowed to transmit their first status messages while the program switch of the controller 16 is ON. The processor 82 will log in each detector as it receives its first status report signal.

The DIP switch assemblies of the controller 14 and detectors 16 can be preset before installation of the system at the protected location, if desired, so that the system 10 can be installed simply by positioning the controller 14 and detectors 16, plugging the controller into a suitable AC or DC power source and turning on the controller 16 through power switch 70. Preferably, the processor 82 is configured to display a message on the LCD 76 if the controller 14 is switched ON with the program switch OFF and no detectors 16 have been programmed into the controller.

Monitoring of the detectors 16 by the controller 14 is automatic as is the response of the controller 14 to the various signals sent by any detector 16. The system 10 can be removed from the site for installation elsewhere simply by removing the detectors 16 from their deployed positions, preferably unplugging the controller 14 from an AC power supply or from a DC power supply if an external DC power supply is used, and carrying away the detectors 16, controller 14, the power supply cable(s) and any DC power supply for reinstallation and reuse.

One of ordinary skill will appreciate that monitoring systems of the present invention are entirely portable, preferably hand portable, and are fully capable of independent, autonomous operation involving minimal skill levels for set up, installation, operation and removal. The system is entirely self contained, can be hand carried to any location and be installed and operating in a matter of minutes. The controller is itself equipped with multiple operator trouble and alarm warning indicating devices, both audible and visual, as well as being configured to pass on alarm and trouble state warning signals through the automatic telephone dialer and through the RS 232 serial communicator, if provided. The controller is capable of disconnecting or deenergizing electrically operated equipment while providing auxiliary AC power during an emergency, assuming an AC power supply is available. The system can be used indoors or out. The ease of movement, installation and use of the presently described system enables it to provide, for the first time, a viable temporary emergency backup for virtually all existing security systems hard wired to any extent. This is depicted in phantom in FIG. 1 by detectors 16' of an inoperative, hard-wired system, being backed up by system 10 of the present invention.

Attached as an appendix is a listing of the object code of the operating program for the preferred processor.

While preferred embodiments of the invention have been disclosed and certain modifications suggested, other embodiments and modifications may occur to those of ordinary skill in the art. For example, only some of the various audible and visible alarm indicators and external communication and control signals and connections disclosed need be provided and others might be substituted for or added to those disclosed. The appended claims are intended to cover these and all such other embodiments and modifications which fall within the true spirit and scope of the invention.

APPENDIX

```
:02000000801E60
:030003000207AD44
:03000B000208D315
:030013000208558B
:03001BD00209606A
:10002000758168758000739 0DF75A07975B0FFD215
:10003000A700C2A71205EA7580FFC2A000E58000F4
:10004000D2A0F51E90055A1205C3D2AAD2A8D2ABEF
:10005000D2AFD28E852627C2A500D2A5309350 30CC
:10006000921420141B20161D201518209106301301
:10007000E602045621255320 88C20B12084DB0D772
:10008000020 2A601FBC216E525B400CBE51FB400B1
:100090001C300FC3D20112084D75F05F78FFC2A566
:1000A00000D2A5D8F9D5F0F4C20112084D80A830CD
:1000B000050830010575202080037520007525 0096
:1000C000C20BC20A12084D7829A926B9000280186D
:1000D000E51FB40005E6543F8006E630E702544 0D1
:1000E000F60808D9EB751F00C2A500D2A53093F819
:1000F00075F0FF3093F2D5F0FA0137C215300B09B5
:10010000C20BC207D20212084DE526B40002015705
:100110007829A826E620E707543FB43F01160608CE
:1001200008DBF1015774FF251F3002016ED207C290
:10013000041208 4DC20CC21D74011205BDE526B4CF
:1001400000059002438003900254120 5C375F0FF2E
:10015000C2A500D2A5D5F0F8209102412785262717
:10016000E526B420127401120380900265120 5C3B4
:10017000D204120 84D4112C2A500D2A5300C0DC206
:10018000C748012058090028712 05C320930875A8
:1001900026008526278 08E2013052091DA4127C26C
:1001A0000412084DB5191DB12D7580FFC2A000E510
:1001B0008000D2A0F51E7828A926B900028043E665
:1001C000541F851C19E51830E30B740112058D900E
:1001D00002761205C3D204C21312084DB099080892
:1001E000D90D8020C21D74011205BD742312057C97
:1001F000E51C1203DB90029B1205B7D204120 84DD9
:10020000C2132177A61908760008052 6C213C21D5D
:100210002160C2A500D2A5209305752600212520C6
:1002200091F0C204120 84DD1AD852627C2071208ED
:100230004DC2A500D2A575F0FFC2A500D2A5D5F08C
:10024000F801572050524F4752414D20434C4541F1
:100250005220200D2050524F4752414D20414444DE
:10026000202020200D2050524F4752414D204C4914
:10027000 4D495420200D4552524F522D204455508 7
:10028000 4C494341544500 57524F4E47204143433B
:100290004553532023202 00D204F5554204F4620F6
:1002A00052414E47450DC21474011205BD300A1B90
:1002B000C20A9002BA1205C36178454D45524745BE
:1002C0004E435920534855544 44E0DE526B400136F
:1002D00090040F1205C3D221D204D205D20F120806
:1002E00D4D6178C221E51F24FF5002617A30A620BB
:1002F00030B51DD220D2059002FF1205C3B0594DA2
:1003000041494E204241545445525920 4C4F570DBB
:10031000C220E526C395272378282BF874231205E0
:100320007CE61203DB9004200BE6C22230E605904A
:10033000042DD222C223543F24C5500F18E654E0A6
:10034000245F400790043AD205D2231205B7202239
:10035000072023 04C2048004D204D20E12084DD513
:10036000271685262730 0E04D20FB00AC20F2020C0
:10037000052021 02C205C20E01577829 8526F0A961
:100380001 7E630E709543FB5010418E6800E0B0867
:10039000 5F0EEC20DE523B50104D20D71AD0517FE
:1003A000E51F2401B51703751701020057C9147121
:1003B000DBC9300009C2179004471205BD22900415
:1003C000001205C3F9748712058DE954E003C404D3
```

```
:1003D0002430120 57C74C612058DE9541F2401C017
:1003E000F075F000C3940A400405F080F7240AC5B4
:1003F000F0243012057CC5F0243012057CD0F022A8
:100400002D5A4F4E4520202020434841 4E230D4E6B
:100410004F205452414E534D49545445525320 0D90
:1004200020434841 4E2E204F4B415920 0D204C4F28
:10043000572042415445452390D204E4F205245A9
:1004400053504F4E53450D20454D4552472E205396
:10045000485554444E0DC21385191DB12D7828A955
:1004600026E6B519028006080 8D9F681E30BE518E2
:1004700030E33BE620E7355440448 0F6051FE51F96
:10048000543F46F6E51F24DF5002151F851F172035
:10049000A605D20712084DE51BB408051207EC802B
:1004A0000BB407051207EC8003120804 81E330E265
:1004B0000BE64440F6D20512084D8004E6549FF620
:1004C000E51830E011740112058D9004E61205C3A1
:1004D00085191D12055DE654C0F630E7067600185F
:1004E000E691F5020057344553542043484 14E4E7F
:1004F000454C20230DAA1FBA0002800C151FB51F32
:10050000177829AA1FBA0011200A0DC206C201C21B
:10051000 2C200C20B12084D22E630E70918E63469
:10052000E0245F500708080 8DAEFC20B22740112BA
:10053000058D90056B1205C3748512058DE51D545C
:10054000E003C404F51B243012057C74C612058D2B
:10055000E51D541FF51CE51D61DB20205359535444
:100560004 54D20524541443920200D5A4F4E4520BB
:10057000202020434841 4E2E20202000D12059ED2DF
:10058000A3C2A4F58000D2A100C2A100221205 9E40
:10059000C2A3C2A4F58000D2A100C2A10022C0E083
:1005A0007580FFC2A3D2A400D2A100E58000C2A141
:1005B00000020E7EFD0E022C0007806800AC0007873
:1005C00008800 4C0007809C0E0C217E493A3D802F1
:1005D000D217840D05D0E000002230170 8C217C80A
:1005E00074C0B18DC812057C80E17580FF75F0671D
:1005F0007800E4F608D5F0FB7589117588047598C4
:10060000007587807 5A80075B80275BD3C758BAF35
:10061000C0D053D00043D01079147A5A7805D0D083
:10062000743812058D12058D12058D740C1205800E
:10063000740112058D740612058DC2A57422120 76D
:10064000358A068B0712079CB50620F4B5071C787F
:10065000267400120735A602AD260D120735A60234
:10066000008A603082401DDF3C2A222F18E74007AE9
:10067000AA7B551206E47400120735EAB4AA06EB09
:10068000B45502801F740112058D9006931205C3A4
:10069000020668 20204D454D4F5259204552524F76
:1006A000522020075260075270000000C2AFC241
:1006B000A5C2A3000000F18E78267D008526F005F6
:1006C000F0E6FA08780008ED1206E40DD5F0F21210
:1006D0000079CFAF4FB74221206E4C2A2740012070B
:1006E00011D2AF22C0E04440120711EA1206FBEB20
:1006F0001206FB12077DC2A2D0E0227C0833400420
:10070000C2A38002D2A312077812075CDCEFC2A357
:10071000 22C2A2120778D2A2120778C0E012075CA8
:10072000D2A312077812076700001207 6DD0E012FB
:10073000 06F8C2A322C0E0D2A4448012071112071 4
:10074000 4BFA12074BFBC2A2D0E0227C08120767CB
:10075000C330A401833312076DDCF222D2A5120715
:10076000 73C2A512077322D2A512077322C2A51263
:10077000077322790 1D9FE22790FD9FE22D2A4C2B1
:10078000A2F178D2A212075C30A4FAC2A22274307D
:10079000120711742012071112077D227800E41248
:1007A000D7352401C82A2BC88422F4CB22C0E0C0EF
:10078000D053D00043D010E525B4001CD20A20A6A7
:1007C00005D20712084D051FE51F24DF5002151F33
:1007D000851F25851F17F1EE30B2FD78FFC2A500F9
:1007E000D2A530B2F3D8F6D0D0D0E032D208D200C1
:1007F000D201D202D2061Z084D120821D20B751274
:100800005AC21522D209D200D201D2061 2084D20B6
:100810000B0FD20B309005751 25AB0037512B4C2BB
:1008200015C0EDE51F24FE4021C0F0C000D2031235
:10083000084D75F06478FFC2A500D2A5D8FED5F0AA
:10084000F4C20312084DD000D0F000E0228520B001
:10085000D2A7C2A722C0E0C0F0C0D053D00043D07E
:100860000B201033758C00758A00D28C30B3FDC21D
:100870008CE4258C605673BCF4758A10D28CD2A9C4
:10088000D210C212D296C21B79147A007B007C0072
:100890020B402D21D8035E58C858AF0B58CF8FE37
:1008A000AFF0EF24C4EE3409500AEF24DCEE340537
:1008B00040028011EF24EBEE3403500EEF24B0EE66
:1008C00034004006B31209638002D218D0D0D0F0B1
:1008D000D0E032C28C758CF4758A10D28CC0D053A3
:1008E000D00043D00820124FD967201C3630112D7C
:1008F000C28CC0E0C21CEAB518 1FEBB5191BECB5E1
:100900001A177904C3120963D9FB8A18CBF4CBBB6D
:10091000198C1AD21CD0E0800AD0E0C21CBA188835
:10092000198C1AC28C758CC5758A67D28CC210D28C
:10093000 12D211D296801C301C1CC0E0E51EB51AE4
:10094000006D213C20C8002D20CC21CC210C211D03B
:10095000E0B296D0D032D0D0C210C211C212D21999
:10096000C21D32CA13CACB13CBCC13CC22C0D05376
:10097000D00043D010C28E758D3C758BAFD91079E5
:10098000 14D214DB047B05D216DA047A5AD215D28B
:040990008ED0D03203
:00000001FF

A:\>
```

We claim:

1. A portable central controller for a portable security system comprising:

a hand portable housing;

a radio receiver circuit within the housing;

a signal processor circuit within the housing configured to analyze radio signals received by the receiver circuit to identify an alarm report signal transmitted by any of a plurality of separate, radio signal transmitting detectors and to identify the detector of the plurality transmitting any alarm report signal identified, the signal processor circuit being further configured to generate an operator alarm device activation signal in response to an identified alarm report signal; and a power circuit in the housing configured to selectively power the controller from either a DC power source external to the housing or an AC power source external to the housing.

2. The controller of claim 1 further comprising multi-conductor connector means coupled with the power supply circuit and accessible from outside the housing for releasably coupling the power circuit with a power source external to the housing.

3. The controller of claim 2 wherein the multi-conductor connector means is a single connector having a first plurality of conductors allotted to releasably couple the controller with an AC power source external to the housing and a second plurality of conductive allotted to releasably couple the controller with a DC power source external to the housing.

4. The controller of claim 1 in a portable wireless security system, the system further comprising the plurality of separate, radio signal transmitting detectors, each detector including a power source, a sensor, circuitry coupled to the sensor and power source, the circuitry being configured to generate and transmit an alarm report radio signal in response to a sensed, predetermined environmental condition, the radio signal being coded to identify the individual transmitting detector.

5. The controller of claim 1 further comprising an audible alarm warning device supported by the housing and activated by the processing circuit in response to an identified alarm signal.

6. The controller of claim 1 further comprising a visible alarm warning device supported by the housing and activated by the processing circuit in response to an identified alarm signal.

7. The controller of claim 1 further comprising at least one battery within the housing, the one battery being coupled with the power circuit and powering the controller.

8. The controller of claim 7 in combination with a multi-conductor cable having a first end with a connector adapted for releasable coupling with the controller and a second end adapted for coupling with a power supply external to the connector.

9. The controller and multi-conductor cable combination of claim 8 further comprising an external DC battery the controller through the second end of the multi-conductor cable, the DC battery having a capacity sufficient to power the controller continuously for at least several days in a monitoring condition and to thereafter power the controller continuously for five minutes while the controller is in full alarm.

10. The controller of claim 1 further comprising a visual display on the housing, the signal processing circuit being configured to display sequentially the identity of each detector transmitting an alarm report in order of identification of the alarm reports by the signal processing circuit.

11. The controller of claim 1 in combination with a separate shunt trip circuit breaker having an activation signal connector, the controller further comprising a connector accessible from the exterior of the housing and configured to mate with the shunt trip circuit breaker connector, the signal processing circuit being configured to trip the circuit breaker in response to the operator alarm device activation signal.

12. The controller of claim 2 in combination with a multi-conductor cable having a first end with a connector adapted for removable coupling with the multi-conductor connector means and a second end adapted for coupling with a power supply external to the controller.

13. The controller and multi-conductor cable combination of claim 12 further comprising an external DC battery coupled to the second end of the multi-conductor cable, the external DC battery having a capacity sufficient to power the controller continuously for at least several days in a monitoring condition and to thereafter power the controller continuously for five minutes while the controller is in full alarm.

14. The controller of claim 9 in a portable wireless security system, the system further comprising the plurality of separate, radio signal transmitting detectors, each detector including a power source, a sensor, and circuitry coupled to the sensor and power source, the circuitry being configured to generate and transmit an alarm report radio signal in response to a sensed, predetermined environmental condition, the signal being coded to identify the individual transmitting detector.

15. The controller, multi-conductor cable and external DC battery combination of claim 9 wherein the controller further comprises an audible alarm condition warning device and a visual alarm condition warning device, both warning devices being mounted to the housing so as to be audible and visible, respectively, from outside the housing, the warning devices being coupled with the power circuit and activated by the operator alarm device activation signal, the external DC battery having greater power capacity than does the internal battery.

16. The controller and shunt trip circuit breaker combination of claim 11 wherein the circuit breaker has at least a 220 VAC capacity and wherein the controller further comprises a first releasable electrical connector exposed on the housing and electrically coupled with the power circuit and an AC plug receptacle exposed on the housing and electrically coupled with the first releasable electrical connector so as to provide alternating current fed into the first releasable electrical connection from outside the controller through the AC plug receptacle from the controller.

17. The portable central controller of claim 1 further comprising:

a first plurality of conductors at least partially exposed through the housing and coupled with the power circuit, the power circuit being configured to convert alternating current received through the first pair of conductors from an AC power source outside the housing into direct current powering the controller; and a second plurality of conductors separate from the first plurality and also at least partially exposed through the housing and coupled with the power circuit, the power circuit being configured to receive direct current powering the controller from opposing poles of a DC power supply external to the housing through the second plurality of conductors.

18. The controller of claim 17 further comprising a hand portable battery DC power supply outside the housing releasably coupled with the power circuit of the controller through the second plurality of conductors.

19. The controller of claim 18 further comprising an internal battery within the housing further coupled with the power circuit simultaneously with the external battery DC power supply, the internal battery having a power storage capacity less than the hand portable battery DC supply outside the housing.

20. A method of providing temporary environmental hazard security monitoring over an extended area in which a hard-wired security system monitoring at least said environmental hazard is already installed comprising the steps of:

carrying and installing by hand about the area while the hard-wired system is inoperative, a plurality of individual detectors and a central controller, each detector being hand portable and including a sensor, a radio transmitter circuit, and a self-contained power source for independently powering the detector, the central controller being hand portable and including a housing containing a radio receiver circuit, a signal processing circuit coupled with the receiver circuit, a power circuit coupled with the processor circuit and the radio receiver circuit and having a multi-conductor connector at least partially exposed on the outside of the housing:

locating the central controller within range to receive radio signals transmitted by each of the detectors; and electrically coupling the central controller through the connector selectively with either an external AC power supply available at the location or a hand portable external DC power supply carried to the location and activating the controller.

21. The method of claim 20 further comprising the steps of gathering up the distributed detectors, uncoupling the portable central processor from the power supply and carrying away the plurality of detectors and unplugged central processor to remove the system from the protected area after the hard-wired system is again operative.

22. The method of claim 21 wherein the central controller further includes an internal battery power supply installed in the housing so as to supply electricity to the controller and the method specifically includes the step of electrically supplying the central controller with power from the hand portable DC power supply carried to the location while the internal battery power supply remains installed in the controller.

* * * * *